United States Patent [19]

Zaffrann et al.

[11] 3,958,095

[45] May 18, 1976

[54] DISCONNECT SWITCH

[75] Inventors: Albert A. Zaffrann; Frank A. Grabarczyk, both of Milwaukee; Jay M. Erdman, Cedarburg, all of Wis.

[73] Assignee: Allen-Bradley Company, Milwaukee, Wis.

[22] Filed: Oct. 21, 1974

[21] Appl. No.: 516,388

[52] U.S. Cl. ..... 200/293; 200/144 R; 200/153 G

[51] Int. Cl.[2] ..... H01H 1/64

[58] Field of Search ..... 200/48 R, 162, 271, 200/272, 273, 274, 280, 281, 289, 329, 336, 15, 17 R, 18, 144 C, 158, 293, 50 AA, 50 A, 50 B, 50 C, 144 R, 307, 153 G, 153 H, 153 V; 335/8, 9, 10, 132; 317/112, 119

[56] References Cited

UNITED STATES PATENTS

| | | | |
|---|---|---|---|
| 678,178 | 7/1901 | Hewlett | 200/50 C |
| 2,281,052 | 4/1942 | Samzelius | 200/50 A |
| 2,743,338 | 4/1956 | Graybill | 200/153 G |
| 2,874,252 | 2/1959 | Wenzel et al. | 200/280 |
| 3,496,319 | 2/1970 | Norden | 200/144 R |
| 3,632,935 | 1/1972 | Stegmaier | 200/281 |
| 3,684,849 | 8/1972 | Zubaty | 200/162 |
| 3,840,717 | 10/1974 | Pekrul et al. | 200/15 |

*Primary Examiner*—Robert K. Schaefer
*Assistant Examiner*—M. Ginsburg
*Attorney, Agent, or Firm*—Quarles & Brady

[57] ABSTRACT

A three-pole disconnect switch includes a crossbar which is rotatably mounted to a housing and pivots three movable contact blades between opened and closed positions. Each movable contact blade is removably mounted to the cross-bar and makes slidable electric contact with a connector. When in its closed position, each movable contact blade makes electrical connection with a stationary line contact. Modular arc chutes are slidably received in mating cavities formed in the housing above each set of contacts and a pair of auxiliary contact cartridges are received in chambers formed in the housing between the main contacts. A trip mechanism is mounted to the side of the housing and couples one end of the crossbar to a manually operated handle.

11 Claims, 11 Drawing Figures

DISCONNECT SWITCH

BACKGROUND OF THE INVENTION

The field of the invention is disconnect switches, and more particularly, manually operated disconnect switches having a set of movable contact blades which are pivoted by rotating a crossbar between an opened and closed position.

As illustrated in U.S. Pat. No. 1,918,248, the crossbar which carries the movable contact blades is rotatably mounted to an insulating block that is typically mounted inside a cabinet and the crossbar is coupled to a handle mounted on the exterior of the cabinet through a spring loaded trip mechanism. The handle and associated trip mechanism may be mounted to one side of the disconnect switch, or as shown in U.S. Pat. No. 3,602,676, the handle may be mounted to the front of the cabinet and its trip mechanism coupled to a point intermediate the ends of the crossbar.

When in their closed position, the movable contact blades electrically connect with a set of stationary contacts to conduct electric current from a set of input terminals to a set of output terminals. As illustrated in the above cited U.S. Pat. No. 3,602,676, each movable contact blade is typically connected to an output terminal through a flexible conductive strap, or pigtail, that allows the movable contact blade to be freely pivoted between its opened and closed positions.

As illustrated in U.S. Pat. No. 3,684,849, the current carrying capacity of disconnect switches is often enhanced by employing arc chutes. Such arc chutes are comprised of a series of metallic deionization plates which are mounted to the insulating block and positioned directly above each movable contact blade. Arcs which may result when the disconnect switch is opened are cooled and eventually extinguished by the deionization plates in each arc chute.

Disconnect switches are often employed with other electrical components to form control circuits such as motor starters. In such control circuits the disconnect switch serves not only to control the main electrical power through the operation of its movable contact blades, but also, to control the operation of other elements in the control circuit through the operation of auxiliary contacts which are mounted to the insulating block. The number and nature of such auxiliary contacts vary with each particular application of the disconnect switch and, therefore, these are typically fastened to the insulating block at any point which allows them to be mechanically coupled to the rotatable crossbar.

Prior disconnect switches are difficult to maintain and service. For example, if a movable contact blade is to be replaced, the arc chute located directly above it must be removed and the flexible strap which connects it with the output terminal must be unfastened before the blade can be detached from the crossbar. Although some prior art structures allow the arc chutes to be removed and replaced as an integral unit, the fastening devices which hold such arc chutes to insulating blocks are often accessible only by removing the insulating block from its enclosure. Also, although prior auxiliary contacts are typically enclosed in self-contained cartridges, these cartridges are mounted to the front or side of the insulating block using fastening means which may not be easily accessible when the disconnect switch is mounted within its enclosure.

SUMMARY OF THE INVENTION

The present invention relates to an improved disconnect switch which is particularly easy to service and maintain. More specifically, the disconnect switch includes a base having a pair of vertical side walls which define a housing and vertical divider walls which define a plurality of compartments within the housing; a crossbar mounted to the base for rotation about a horizontal actuation axis; a set of movable contact blades, each being fastened to the crossbar and being disposed within one of the compartments; a set of stationary contacts, each being disposed within a compartment to make electrical contact with the movable contact blade therein when the movable contact blade is in its closed position; and a set of connectors each being disposed within a compartment to make sliding electrical contact with the movable contact blade therein.

The stationary line contacts are electrically connected to the input terminals which receive electrical power and the connectors are electrically connected to the output terminals. The connectors slidably engage the movable contact blades and as a result, the movable contact blades can be easily removed from the crossbar without physically unfastening them from the output terminals.

A further aspect of the invention resides in a disconnect switch having a set of modular arc chutes which are each slidably mounted to the base and disposed within a compartment directly above a movable contact blade. Each modular arc chute includes a case which supports a set of deionization plates and the case is slidably received in a mating cavity formed in each compartment. No fastening means are attached to the modular arc chutes and each is separately removable from the front of the disconnect switch.

Yet another aspect of the present invention is the manner in which auxiliary contacts are mounted to the disconnect switch and coupled to its crossbar. Auxiliary cartridge chambers are formed in the base between its side walls and each such chamber opens to the front of the disconnect switch. Each auxiliary cartridge chamber communicates with an actuator element that is formed on the crossbar. The auxiliary contacts are enclosed in a cartridge which is shaped to fit within one of the chambers and which includes a slidable cam member that couples with the actuator element on the crossbar.

Yet another aspect of the present invention is a disconnect switch in which the trip mechanism and associated manual operating means may be mounted to either side of the base. The rotatably mounted crossbar communicates through openings in each side wall of the base and identical coupling elements are formed on each of its ends. The trip mechanism may thus be mounted to either side wall on the disconnect switch and coupled to the crossbar.

A general object of the present invention is to provide a disconnect switch in which assembly and maintenance of its elements is facilitated. The modular arc chutes are easily removed by pulling them from their mating cavities. The deionization plates are thus easy to inspect as well as the stationary line contacts which are located behind the modular arc chutes. Similarly, each movable contact blade may be removed for replacement by pulling the movable contact blade free of the crossbar. Each set of auxiliary contacts may also be easily removed and inspected or replaced by pulling their associated cartridge from its chamber.

The foregoing and other objects and advantages of the invention will appear from the following description. In the description reference is made to the accompanying drawings which form a part hereof, and in which there is shown by way of illustration a preferred embodiment of the invention. Such embodiment does not necessarily represent the full scope of the invention, however, and reference is therefore made to the claims herein for interpreting the scope of the invention.

DESCRIPTION OF THE PREFERRED EMBODIMENT

Figure 1:
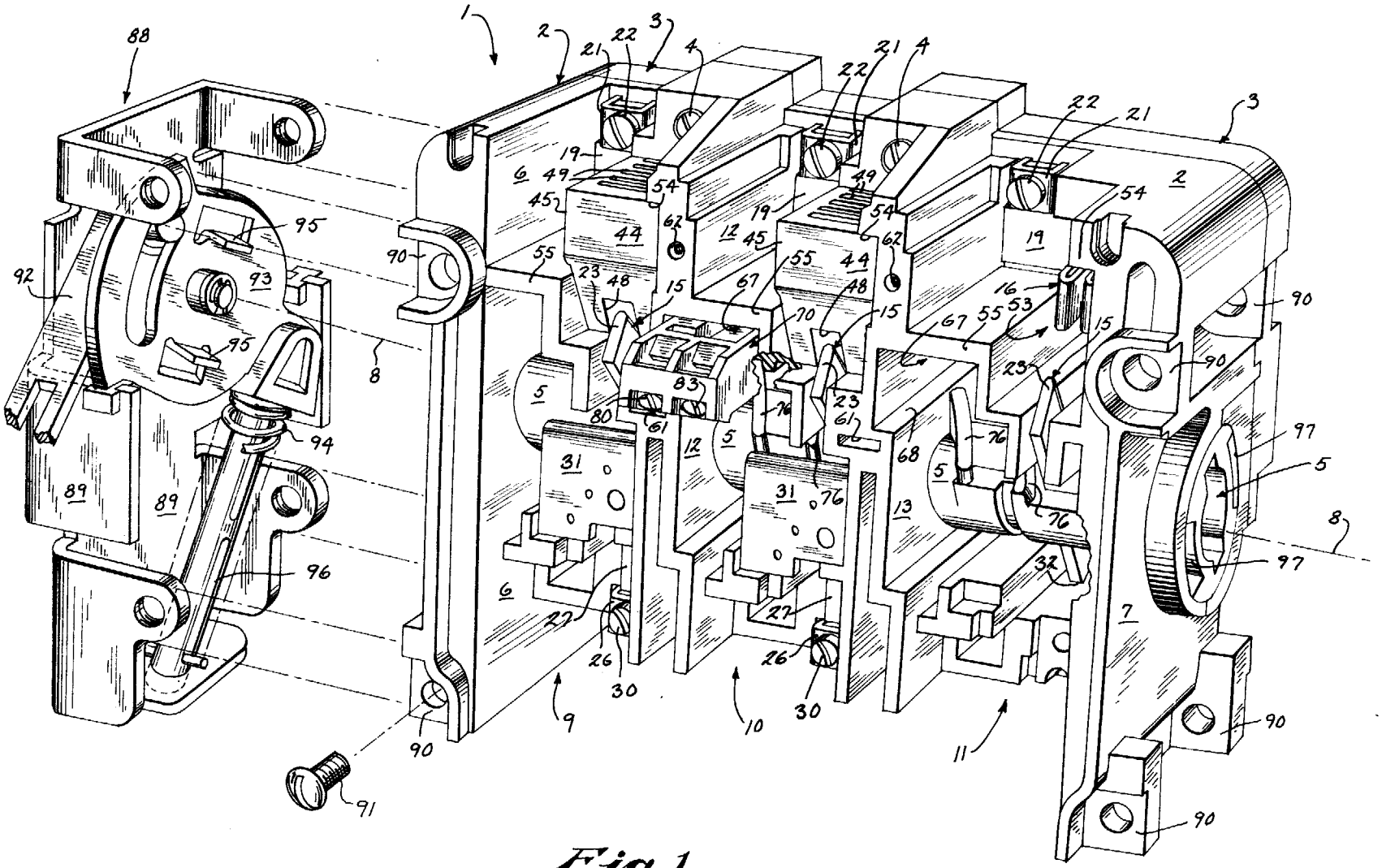
FIG. 1 is a perspective view of the disconnect switch with parts removed and parts cut away.
Figure 2:
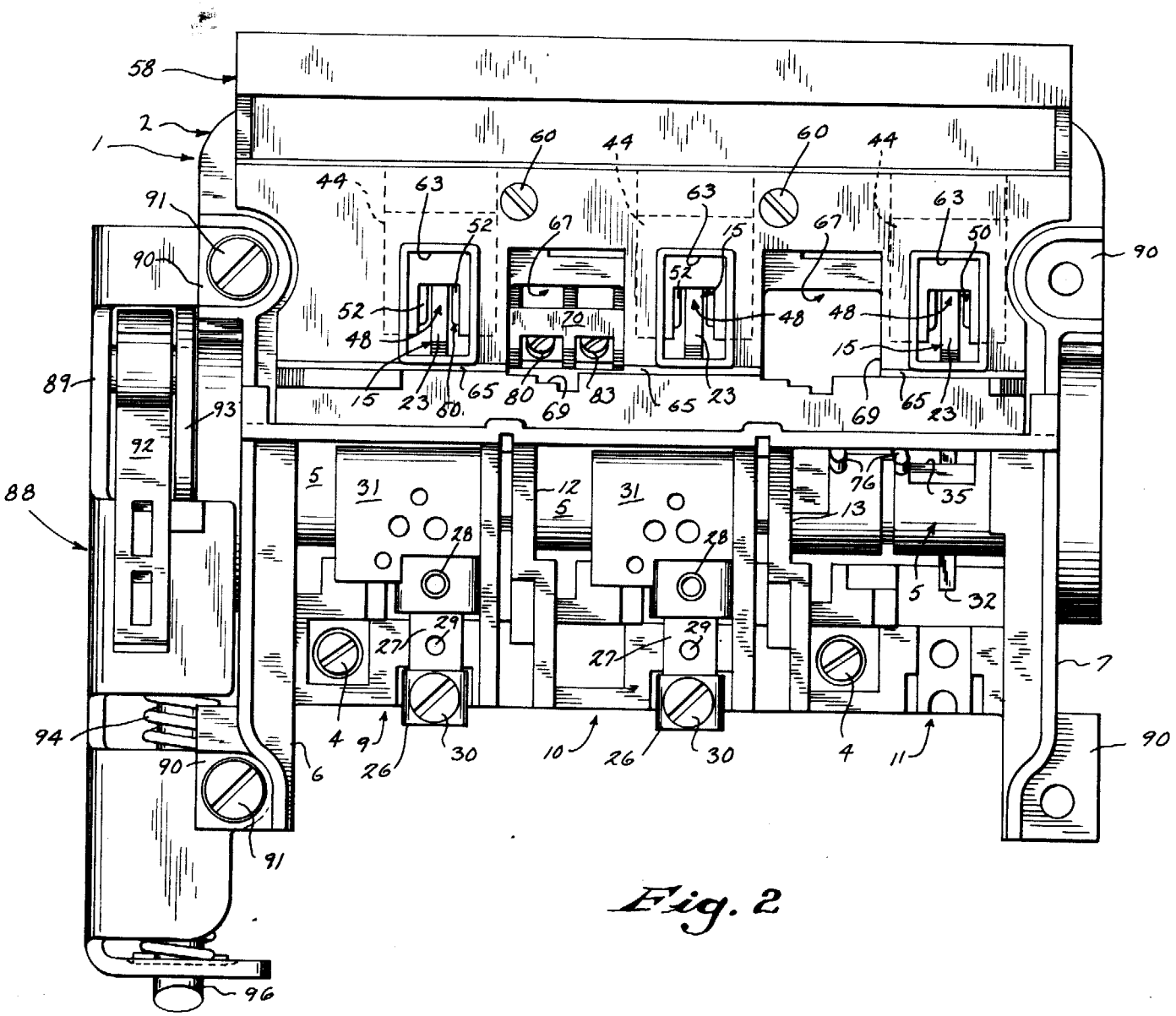
FIG. 2 is a front view of the disconnect switch of FIG. 1.
Figure 3:
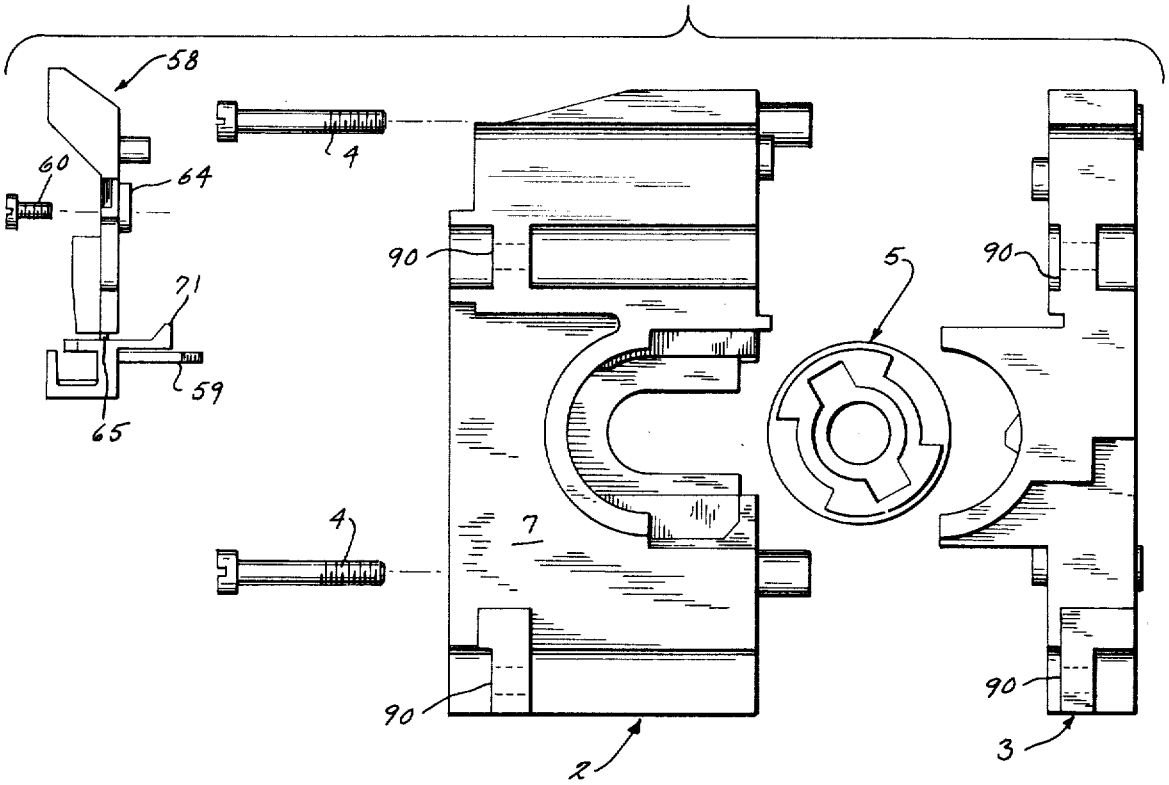
FIG. 3 is an exploded side view of the disconnect switch of FIG. 1.
Figure 9:
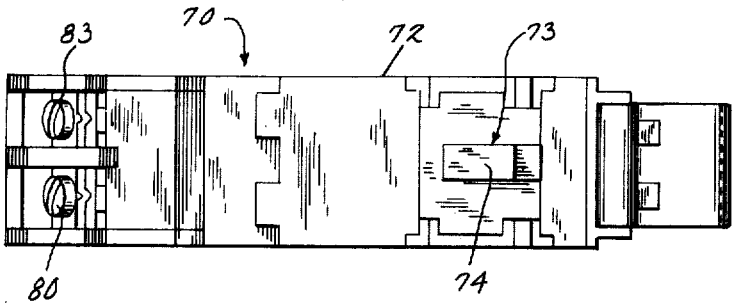
FIG. 9 is a bottom view of an auxiliary contact cartridge which forms part of the disconnect switch of FIG. 1.

Referring particularly to FIGS. 1-3, a two-part housing 1 is formed by a base 2 and a back 3 which are fastened to a mounting plate (not shown in the drawings) by a set of screws 4. The base 2 and back 3 are each molded from an electrically insulating thermoset phenolic material such as that sold commercially under the trademark "SI 45 DUREZ" or "Plenco 509". The housing 1 rotatably supports a crossbar 5 which is journaled to a pair of spaced side walls 6 and 7 and which runs transversely through the interior of the housing 1 along a horizontal actuator axis 8. The housing 1 is divided into three compartments 9, 10 and 11 by a pair of integrally molded vertical divider walls 12 and 13.

The housing 1 encloses a three-pole, single throw disconnect switch and each of the compartments 9–11 encloses the elements of one pole. The three poles are identical, and as shown best in FIGS. 1 and 4, each includes a movable contact blade 15 which is fastened to the crossbar 5 and pivoted about the actuator axis 8 between an opened and a closed position. The movable contact blade 15 is made of copper and includes an operating end which is received between the jaws of a stationary contact 16. The stationary contact 16 is made of copper and is mounted to a metal strap 19 in the plane of the movable contact blade 15. The metal strap 19 is fastened to a back wall 17 by a screw 18 that is received in a threaded opening formed therein and it supports an input terminal 21 that is fastened to the strap 19 by a screw 22. When the crossbar 5 is rotated to its closed position, the movable contact blades 15 are pivoted about the actuator axis 8 and the operating end 23 on each movable contact blade 15 is received by the jaws of its associated stationary line contacts 16. Electrical connection is thus made between the three input terminal lugs 21 and the movable contact blades 15.

Located within each of the compartments 9-11 is a stationary connector 25 which electrically connects each movable contact blade 15 with an output terminal 26. As shown best in FIGS. 1, 2 and 4, the connectors 25 are identical in construction to the stationary contacts 16 and they are fastened to a metal strap 27 which is in turn fastened to the base 2 by a screw 29. The output terminal lug 26 fastens to the lower end of the strap 27 by means of a screw 30 and the strap 27 loops upward and forward to provide an integral mounting plate 31 for a fuse assembly (not shown) in the drawings) which may be mounted directly beneath the disconnect switch. Whereas the jaws of the stationary contacts 16 extend forward, the jaws of each connector 25 extend rearward and receive the lower end 32 of the movable contact blade 15. As the movable contact blades 15 are pivoted between the opened and closed positions, the lower end 32 on each maintains continuous electrical contact with the jaws of its associated connector 25. Therefore, when electrical connection is made between the movable contact blades 15 and stationary contacts 16, three conductive paths are completed between the input terminals 21 and output terminals 26 on the disconnect switch.

Figure 5:
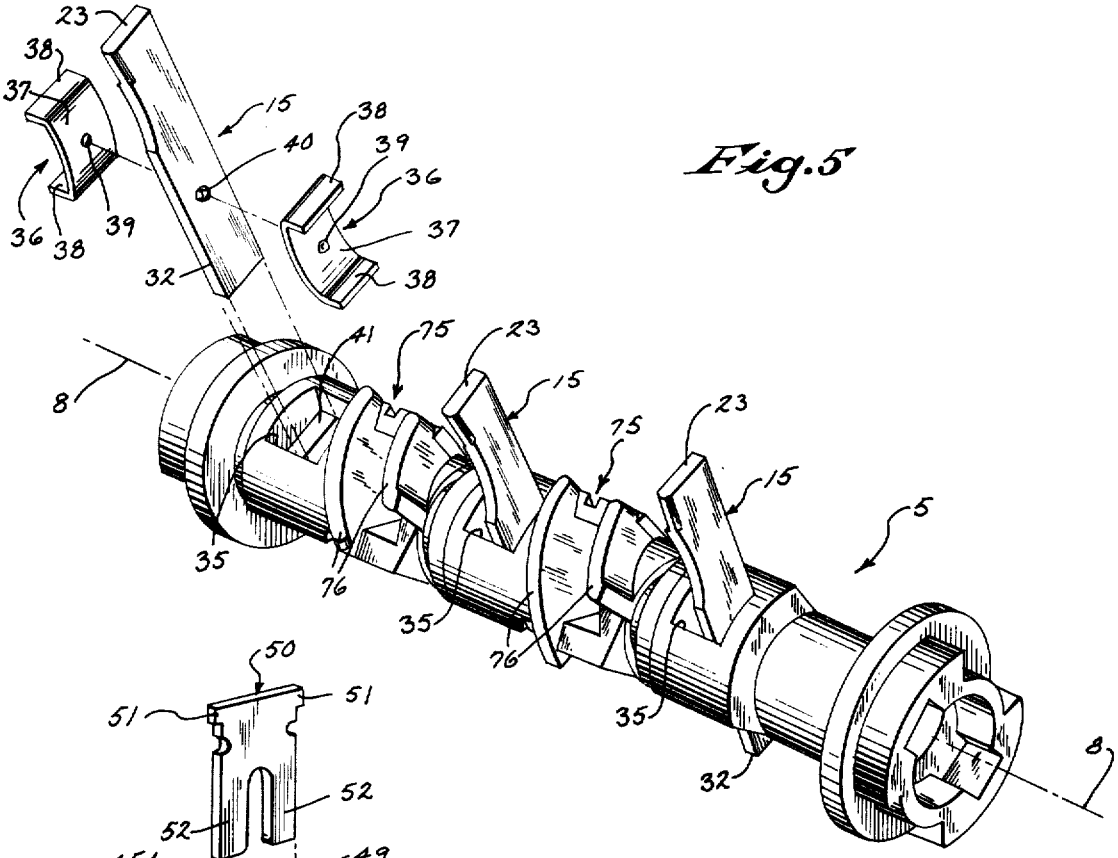
FIG. 5 is a perspective view of the crossbar and associated movable contact blades which form a part of the disconnect switch of FIG. 1.

To facilitate the removal of the movable contact blades 15 for inspection and, if necessary replacement, each blade 15 is removably fastened to the crossbar 5. Referring specifically to FIG. 5, each movable contact blade 15 is inserted through a transverse opening 35 in the crossbar 5 which is substantially rectangular in shape and which contains a detent mechanism that holds the blade 15 in place. The transverse openings are positioned along the actuator axis 8 to align the movable contact blades 15 in the planes of their associated stationary contacts 16. The detent mechanisms include a pair of opposing metal retaining springs 36 each of which has a convex face 37 that is bounded at its ends by outwardly extending ears 38. A semi-spherical protrusion 39 is formed in the center of each face 37 and is received in an opening 40 which is formed through the movable contact blade 15. The retaining springs 36 are positioned within each transverse opening 35 to face one another. The ears 38 wrap around and clamp against recessed surfaces 41 that are formed in the crossbar 5 alongside the transverse openings 35, and the protrusions 39 are sprung towards one another to pinch the movable contact blade therebetween. By grasping the movable contact blade 15 with a suitable instrument, it can be removed by pulling it from between the retaining springs 36. The movable contact blade 15 is replaced by sliding it into the transverse opening 35 until the protrusions 39 snap into place in the opening 40.

Figure 7:
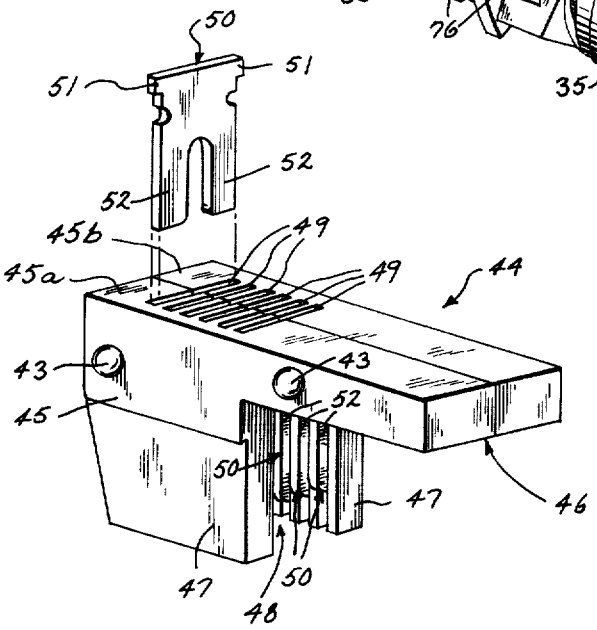
FIG. 7 is a perspective view of a modular arc chute which forms part of the disconnect switch of FIG. 1.
Figure 8:
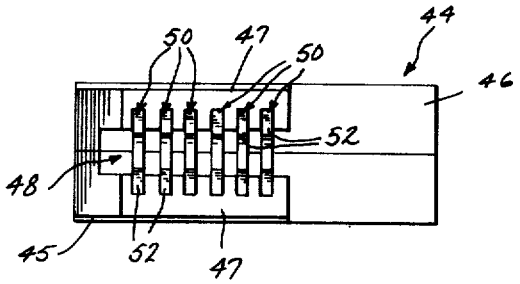
FIG. 8 is a bottom view of the modular arc chute of FIG. 7.

Positioned within each compartment 9–11 and located directly above each movable contact blade 15 is a modular arc chute 44 which serves to extinguish any electrical arc that may be generated when the movable contact blades 15 are pivoted from their closed position to their opened position. Referring particularly to FIGS. 1, 7 and 8, each modular arc chute 44 includes a two-part case 45*a* and *b* which is molded from a suitable thermoset polyester insulating material and which is held together by a pair of rivets 43. The case 45 includes an overhang portion 46 which extends rearward and provides an insulating barrier directly above its associated stationary contact 16. The case 45 also includes a pair of side walls 47 which extend downward to form an archway 48 through which the operating end 23 of the movable contact blade 15 swings when pivoting between its opened and closed positions. A set of six rectangular slots 49 are formed vertically through the case 45 and each slot 49 receives a metal deionization plate 50. The plates 50 are thus aligned one in back of the other in closely spaced vertical planes, and each is retained in its associated slot 49 by a pair of outwardly extending ears 51 which rest in pockets (not shown in the drawings) formed in each slot 49. Each deionization plate 50 includes a pair of downward extending legs 52 which form an arch through which the operating end 23 of the movable contact blade 15 passes. As is well known in the art, the electrical arc which is generated when the movable contact blade 15 opens circuit is broken into a series of short arcs by the successive deionization plates 50, and these are extinguished by the cooling effect which the deionization plates 50 provide. It can be appreciated by those skilled in the art that the number and spacing of the deionization plates can be varied to alter the current interrupting capability of the switch.

Each modular arc chute 44 is slidably received in a mating cavity 53 which is integrally formed within each of the compartments 9–11 above the crossbar 5. Referring particularly to FIG. 1, each cavity 53 is a substantially rectangular cavity which is defined along one of its vertical boundaries by one of the upright walls 12, 13 or 7 and which is defined along its top by an overhang 54 that is integrally formed on each of the walls 12, 13 and 7. Stepshaped barrier walls 55 are integrally formed to the base 2 within each compartment 9, 10 and 11, and these form both the lower boundary of each cavity 53 and its left side. The outer dimensions of each modular arc chute 44 are slightly tapered to provide a wedging effect when the arc chute 44 is inserted into its cavity 53 from the front. Each modular arc chute 44 may be removed separately by pulling it straight forward from its cavity 53.

Figure 4:
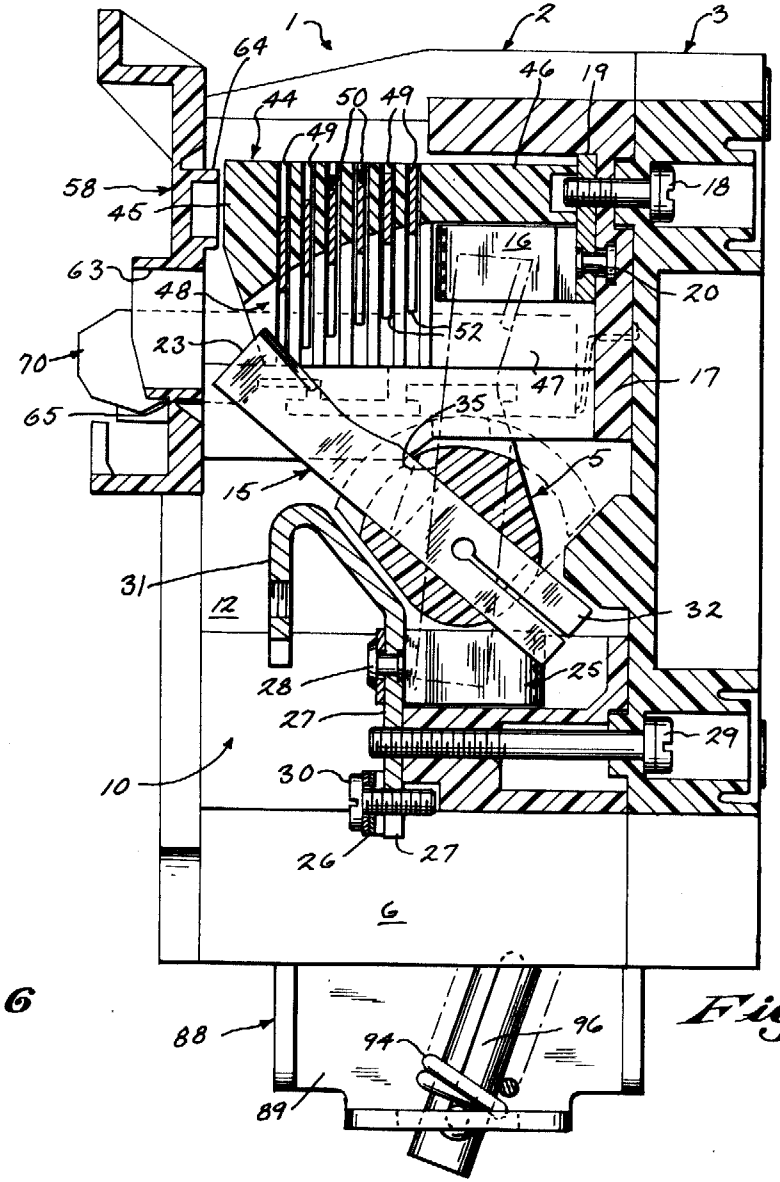
FIG. 4 is a side view with parts cut away of the disconnect switch of FIG. 1.
Figure 6:
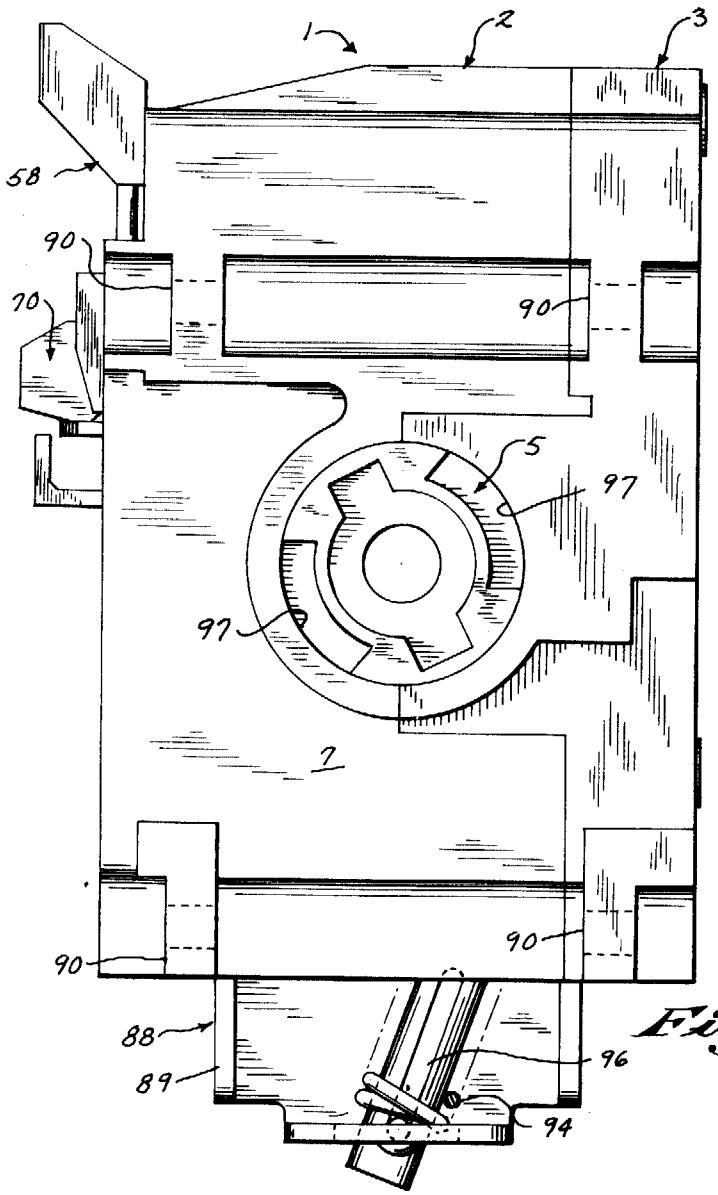
FIG. 6 is a side view of the disconnect switch of FIG. 1.

As shown best in FIGS. 1–3, a cover 58 is mounted to the front of the housing 1 to substantially enclose that portion of each compartment 9, 10 and 11 above the barrier wall 55. The cover 58 is molded from a thermoplastic, flame retardant, polypropylene material, and it is fastened to the base 2 by two pairs of integrally molded prongs 59 and a pair of captive screws 60. As shown best in FIG. 1, the prongs 59 are received in openings 61 which are formed on the front edges of the divider walls 12 and 13 and the screws 60 are received in openings 62 which contain threaded inserts. Referring particularly to FIG. 2, a set of three windows 63 are formed in the cover 58 and each is aligned directly in front of the archway 48 of a modular arc chute 44. Thus, when in their opened position, the operating end 23 of each movable contact blade 15 is readily visible through one of the windows 63 and can be easily inspected for wear. As shown in FIGS. 3 and 4, a set of three stops 64 are integrally molded on the back side of the cover 58 directly above the windows 63. When the screws 60 are tightened, the stops 64 bear against the forward ends of the modular arc chutes 44 to retain them tightly in their cavities 53. When the arc chutes 44 are to be removed, the captive screws 60 are unfastened and the cover 58 is folded downward about a hinge 65 to expose these cavities 53.

As indicated above, when the disconnect switch is used in control circuits it is often necessary to operate auxiliary contacts. In the preferred embodiment described herein, provisions are made to mount a pair of auxiliary contact cartridges to the housing 1 and couple their operating elements to the crossbar 5. Referring particularly to FIGS. 1, 2 and 4, a pair of auxiliary chambers 67 are formed in the housing 1 between the poles contained within the compartments 9, 10 and 11. Each auxiliary chamber 67 is substantially rectangular in shape and extends rearward from the front of the base 2 to its back wall 17. The top and one side boundary of each chamber 67 are defined by the stepped barrier walls 55 in the compartments 10 and 11, the other side boundary of each is defined by a portion of the divider walls 12 and 13, and the bottom boundary of each is defined by a ledge 68 which is formed in each of the divider walls 12 and 13. A pair of rectangular openings 69 are formed in the cover 58 directly in front of the auxiliary chambers 67 and an auxiliary cartridge 70 is inserted into either chamber 67 through one of the openings 69. As shown best in FIG. 3, a pair of locking mechanisms 71 are integrally formed on the back side of the cover 58, and each locking mechanism 71 extends rearwardly into one of the auxiliary chambers 67. The locking mechanism 71 engages and firmly retains the auxiliary cartridge 70 in place.

Figure 11:
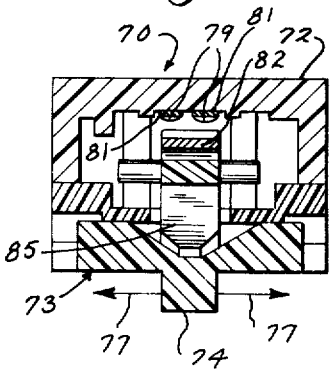
FIG. 11 is a view in cross section of the auxiliary contact cartridge taken along the line 11-11 in FIG. 10.

Referring particularly to FIGS. 5 and 9–11, each auxiliary cartridge 70 includes a relatively long slender case 72 which is molded from a thermoplastic polyester insulating material. A cam member 73 is slidably mounted to the bottom wall of the cartridge 70 and it includes a rectangular coupling element 74 which extends downward therefrom to engage one of two actuator elements 75 on the cross-bar 5. As shown best in FIG. 5, each actuator element 75 includes a pair of closely spaced helical walls 76 which are integrally formed to the crossbar 5 and extend radially outward therefrom to define a channel therebetween for the coupling element 74. When the crossbar 5 is rotated about the actuator axis 8, the cam member 73 on each auxiliary cartridge 70 slides along an axis which is parallel to the actuator axis and which is indicated in FIG. 11 by the arrows 77.

Figure 10:
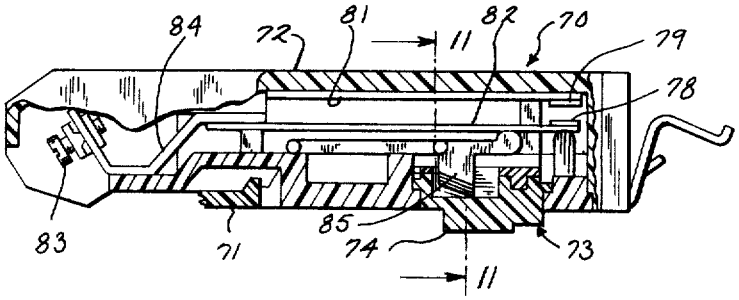
FIG. 10 is a side view with parts cut away of the auxiliary contact cartridge of FIG. 9.

The sliding motion of the cam member 73 operates a set of auxiliary contacts 78 and 79 which are mounted inside the case 72 of each auxiliary cartridge 70. Referring particularly to FIGS. 10 and 11, one of the contacts 79 is stationary and is connected to a terminal lug 80 by a bus 81 and the other contact 78 is supported by a movable contact arm 82 which connects to a terminal lug 83 through a bus 84. A cam follower element 85 is pivotally mounted to the case 72 and located directly beneath the movable contact arm 82. As the cam member 73 slides along its axis 77 in response to the rotation of the crossbar 5, the cam follower 85 operates the movable contact 78 to open and close the auxiliary contacts. It should be apparent to those skilled in the art that many variations can be made in the contact structure within the auxiliary cartridge 70 and for a more detailed description of the particular auxiliary cartridge 70 described herein, reference is made to copending patent application Ser. No. 487,975 which was filed on July 12, 1974 and which is entitled "Auxiliary Switch for Electromagnetic Contactor."

Referring particularly to FIGS. 1, 2, 5 and 6, a trip mechanism 88 is mounted to the left side wall 6 of the housing 1 to couple the crossbar 5 of the disconnect switch with a manually operated handle (not shown in the drawings). The trip mechanism 88 includes a metal frame 89 which is mounted by a set of screws 91 to ears 90 that are integrally formed on the side wall 6. The frame 89 is symmetrical about a vertical plane and it may be mounted in a similar manner to the right side wall 7 of the disconnect switch. A set of four integrally molded ears 90 are formed on the right side wall 7 to mount the trip mechanism 88. The handle (not shown in the drawings) operates through a coupling arm 92 which fastens to the upper end of a pivot plate 93 that is rotatably attached to the frame 89. A trip spring guide 96 connects the bottom end of the pivot plate 93 to the frame 89 and when the handle is operated, the pivot plate 93 is rotated about the actuator axis 8 between an opened and closed position. A trip spring 94 surrounds the guide 96 and provides a strong snap action in both directions. The pivot plate 93 is connected to the crossbar 5 by a pair of tabs 95 that engage arcuate coupling slots 97 which are integrally molded to the ends of the crossbar 5. The mounting ears 90 are symmetrical with respect to the actuator axis 8 to allow the trip mechanism 88 to be mounted to either side of the disconnect switch and to couple with the exposed end of the crossbar 5.

A disconnect switch has been described which embodies the present invention. It should be apparent to those skilled in the art, however, that many variations can be made in this structure without departing from the spirit of the invention, and reference is therefore made to the following claims.

We claim:

1. In a disconnect switch, the combination comprising:

a base having a pair of vertical side walls which define a housing and vertical divider walls which define a plurality of compartments within said housing;

a crossbar mounted to said base for rotation about a horizontal actuation axis, said crossbar extending horizontally through said compartments;

a plurality of current conducting poles, one disposed within each compartment and each pole including a movable contact blade which fastens to said crossbar and swings about said actuation axis between an opened and closed position when said crossbar is rotated about said actuation axis;

an auxiliary chamber formed in said base between a pair of said current conducting poles; and an auxiliary contact cartridge slidably received in said auxiliary chamber and including a cam member which couples to said crossbar and operates a set of auxiliary contacts within said auxiliary contact cartridge when said crossbar is rotated about said actuation axis.

2. The disconnect switch as recited in claim 1 in which an actuator element is formed on said crossbar and couples with said cam member to slide said cam member along an axis parallel to said actuation axis when said crossbar is rotated.

3. The disconnect switch as recited in claim 2 in which said actuator element includes a pair of spaced walls which are integrally molded to said crossbar and which define a helical channel in which said cam member rides.

4. In a disconnect switch, the combination comprising:

a base having a pair of integrally formed side walls which define a housing and an integrally formed divider wall which defines a pair of compartments within said housing;

a crossbar mounted to said base for rotation about a horizontal actuation axis, said crossbar extending horizontally through each of said compartments;

a plurality of movable contact blades, one disposed in each of said compartments and each fastened to said crossbar for swinging motion about said actuation axis between an opened and a closed position;

a plurality of stationary line contacts mounted to said base, each of said stationary line contacts being disposed in one of said compartments to make electrical contact with the movable contact blade therein when said movable contact blade is in its closed position; and a plurality of modular arc chutes, each separately mounted to said base and disposed within respective ones of said compartments, and each including a case which supports a plurality of deionization plates in vertical, spaced relation immediately above the movable contact blade within said respective one compartment.

5. The disconnect switch as recited in claim 4 in which a barrier wall is formed to said base within each compartment to define a cavity in each compartment which slidably receives and retains one of said modular arc chutes.

6. The disconnect switch as recited in claim 5 in which said cavities open to the front of the base and a cover is fastened to the front of the base to retain the modular arc chutes in place.

7. In a disconnect switch having a base made of an electrically insulating material which supports a set of stationary contacts between a pair of spaced side walls, a crossbar which is rotatably attached to said base for rotation about a horizontal actuation axis and a set of movable contact blades fastened to said crossbar for swinging motion between an opened and a closed position, the improvement therein comprising:

coupling means on each end of the crossbar;

mounting means on each side wall of the base; and a trip mechanism for rotating said crossbar in response to the manual actuation of a handle, said trip mechanism being received and held by one of said mounting means on one of said side walls of said base and connected to one of the coupling means on said crossbar.

8. In a disconnect switch, the combination comprising:

a base formed from an electrically insulating material and having a pair of integrally formed spaced side walls;

a set of stationary line contacts mounted to said base and disposed between said side walls;

a crossbar journaled to said side walls for rotation about a horizontal actuation axis;

a set of movable contacts fastened to said crossbar for rotation thereby between an opened position and a closed position in which each of said movable contacts makes electrical connection with one of said stationary line contacts;

first coupling means formed to one end of said crossbar and communicating with the exterior surface of one of said side walls;

second coupling means formed to the other end of said crossbar and communicating with the exterior surface of the other of said side walls; and a trip mechanism mounted to one of said side walls and including a snap action drive mechanism which couples to one of said first and second coupling means to impart a rotary motion to said crossbar when said trip mechanism is operated.

9. The disconnect switch as recited in claim 8 in which said first and second coupling means are identical, openings are formed in the side walls through which the coupling means communicate, and substantially identical mounting means are formed on each side wall about the opening therein for mounting said trip mechanism.

10. In a disconnect switch having a base which supports a set of stationary line contacts that electrically connect to a set of input terminals and which supports a crossbar mounted for rotation about a horizontal actuation axis, the improvement comprising:

a set of movable contact blades each releasably attached to said crossbar for rotation thereby about said horizontal actuation axis between an opened position and a closed position, each having an operating end which makes electrical contact with one of said stationary line contacts and each having a lower end which swings about said horizontal actuation axis;

a set of output terminals mounted to the base; and a set of connectors rigidly fastened to said base and electrically connected to said output terminals, each of said connectors positioned to make continuous sliding electrical contact with said lower end on one of said movable contact blades in both its closed and opened positions.

11. The disconnect switch as recited in claim 10 in which a set of openings are formed transversely through said crossbar and each of said movable contact blades extends through one of said transverse openings and is releasably fastened therein by a detent mechanism, each of said detent mechanisms including a pair of opposing retaining springs which fasten to said crossbar and each retaining spring having a convex surface which bears against its associated movable contact blade to pinch said blade between said opposing retaining springs.

* * * * *